United States Patent [19]

Perry

[11] Patent Number: 4,466,387

[45] Date of Patent: Aug. 21, 1984

[54] LUBRICATION MEANS FOR A TWO-CYCLE INTERNAL COMBUSTION ENGINE

[76] Inventor: John C. Perry, 3170 Falcon Dr., Carlsbad, Calif. 92008

[21] Appl. No.: 541,952

[22] Filed: Oct. 14, 1983

[51] Int. Cl.[3] ..... F01P 1/04; F01P 3/06

[52] U.S. Cl. ..... 123/41.37; 123/73 AD; 123/197 AB; 123/196 R; 184/24

[58] Field of Search ..... 123/41.34, 41.36, 41.37, 123/41.38, 73 AD, 73 R, 73 A, 73 FA, 197 AC, 197 AB, 196 R, 196 CP; 184/24, 26, 27 R, 27 A, 29, 32

[56] References Cited

U.S. PATENT DOCUMENTS

| | | | |
|---|---|---|---|
| 634,529 | 10/1899 | Lee | 123/196 R |
| 1,293,342 | 2/1919 | Coffman | 123/73 A |
| 1,511,867 | 10/1924 | Asbury | 123/73 A |
| 1,907,805 | 5/1933 | Heintz | 123/73 A |
| 2,056,901 | 10/1936 | Kylen | 184/6.5 |
| 2,280,296 | 4/1942 | Mantle | 184/6.5 |
| 2,374,460 | 4/1945 | Rossman | 123/41.37 |
| 2,396,500 | 3/1946 | Gasser | 123/41.37 |
| 2,449,657 | 9/1948 | Kishline | 123/41.37 |
| 2,493,718 | 1/1950 | Chronic et al. | 123/197 AC |
| 2,745,390 | 5/1956 | Heidner et al. | 123/73 A |
| 2,936,748 | 5/1960 | Jensen | 123/196 CP |
| 2,983,334 | 5/1961 | Dalrymple | 123/196 CP |
| 3,396,819 | 8/1968 | Baxter et al. | 184/6.5 |
| 3,656,582 | 4/1972 | Alcock | 184/24 |

*Primary Examiner*—Ethel R. Cross

*Attorney, Agent, or Firm*—Robert G. Upton

[57] ABSTRACT

This invention is a lubrication pumping means contained within one or more reciprocating rods to assure lubrication of the crankpin rod bearing and the wrist pin bearing during operation of a two-cycle internal combustion engine.

9 Claims, 6 Drawing Figures

LUBRICATION MEANS FOR A TWO-CYCLE INTERNAL COMBUSTION ENGINE

CROSS-REFERENCE TO RELATED APPLICATION

This application is related to pending application Ser. No. 526,445, filed August 25, 1983, entitled Lubrication Pump.

BACKGROUND OF THE INVENTION

1. Field of the Invention

This invention relates to a lubrication means for an internal combustion engine.

More particularly, this invention relates to a lubrication pumping apparatus actuated by one or more reciprocating piston rods to assure lubrication of the crankpin bearing and the wrist pin bearing of an internal combustion engine.

2. Description of the Prior Art

Many different ways to lubricate the various rotating parts of an internal combustion engine are well known in the art. For example, with internal combustion engines having oil reservoir sumps, lubricating holes are provided in the rod cap of a piston rod to supply lubricant to the rod crankpin bearing of the crankshaft during operation of the engine. These passages typically are transverse to an axis of the crankpin. The openings may be holes drilled through the rod bearing cap or a slot may be provided at the bottom of the rod cap to allow lubricant to pass into the crankpin bearing areas. This method is sufficient to lubricate the rod crankpin bearing where oil in the sump submerges the crankshaft/-crankpin as the crankshaft revolves within the engine crankcase or engine block.

There are other methods that force lubricant from a pump within an oil sump of an internal combustion engine to various bearing surfaces. For example, oil is forced through a borehole in the crankshaft into the rod crankpin bearing. These types of engines typically have a motor-driven oil pump that supplies lubricant under pressure to all the bearings.

U.S. Pat. No. 2,280,396 teaches a means to lubricate a rod/crankpin bearing by providing a series of spiral lubricating grooves down the bearing surface of a crankshaft that terminates at the crankshaft flywheel. A port, directed from the spiral lubricating grooves through the crankpin to the interior of the bearing surfaces formed between the crankpin and the rod cap, provides a lubricating path to this bearing, thus providing lubricant to the bearing during operation of the engine. Lubricant is drawn from a sump at the bottom of the crankcase, up the front of the engine to the forward end of the crankshaft and from there down the spiral grooves in the crankshaft to the port directing lubricant from the crankshaft to the rod/bearing crankpin. While a means is provided to pump lubricant to a rod/crankpin bearing, there is no means to lubricate the wrist pin connecting the rod to the piston.

U.S. Pat. No. 2,936,748 describes a means for lubricating a two-cycle engine. This invention provides a means to collect oil droplets that separate from a fuel-/oil mixture and directs this separated and collected oil to bearing surfaces within the engine. These two-cycle engines depend for their lubrication upon the more or less entrained in the stream of gaseous fuel charge (fuel-/oil mixture) whereby the lubricant may be selectively directed to critical lubricating points. This patent teaches the utilization of a pressurized lubrication system for two-stroke engines. Collected oil is routed, under pressure, from a crankcase of the engine and is forced into a chamber formed in the crankshaft and from there to a port leading from the crankshaft to the rod/crankpin bearings, thus feeding this collected lubricant, separated from the fuel, to this particular bearing.

This patent provides an oil separation system and a separate pump within the crankcase to direct the separated and collected oil to various bearing surfaces, such as the bearing of the crankshaft and the rod/crankpin bearing. There is however no means to direct lubricant to the wrist pin bearing.

The present invention goes beyond the state of the art in that a lubricant pumping means is provided by utilizing the reciprocating and circular motion of the piston rod to collect and drive lubricant entrained in a fuel/oil mixture within the crankcase of a two-cycle engine to the crankpin and wrist pin bearings. When the piston moves up its cylinder wall, a partial vacuum is created within the crankcase which draws a mixture of fuel and lubricant into the crankcase chamber. The rod connected between the crankpin of the engine crankshaft and the wrist pin of the piston forms an internal passage that communicates between the crankpin rod bearing and the wrist pin rod bearing. A fuel/oil rod inlet hole is positioned between the crankpin and the wrist pin. The inlet hole intersects the bore in the rod and communicates between the interior of the crankcase chamber and the interior passage in the rod. Again, as the piston moves up the cylinder, the partial vacuum created within the chamber draws a mixture of fuel and oil into the chamber and from there into the inlet hole in the side of the rod transverse to the longitudinal bore in the rod shank. Fuel and oil is "scooped" into the interior of the rod as the rod revolves around the crankshaft flywheel. When the rod rotates clockwise from about the three o'clock position to about the nine o'clock position, fuel is scooped into the inlet hole to the rod interior. As the engine is operating, the interior of the rod eventually fills with lubricant, thus assuring a means to lubricate both the crankpin bearing and the wrist pin bearing from within the interior of the rod while maintaining the temperature of the rod within a safe range (especially during high RPM conditions) to prevent potential catastrophic failure of the rod. Inertial forces generated by the reciprocating piston drives fuel and oil contained within the bore in the rod into the crankpin and wrist pin bearing surfaces under high pressure during engine operation.

Insofar as the inventor is aware, no one has utilized the reciprocating and circular motion of a rod/piston combination to direct lubricant into the interior of a rod to lubricate and cool the crankpin and the wrist pin bearings from within a cavity formed in the rod. These types of bearings are especially subjected to intense heat and frictional loads which, in turn, may catastrophically fail these bearing surfaces under extreme conditions without adequate lubrication and cooling. For example, miniature two-cycle engines typically used in model boats and aircraft are capable of operating in a revolution per minute range between 2,000 and 30,000 RPM's. These types of engines are especially vulnerable to rod failure when operating at high RPM's due to intense heat and sparse lubrication.

SUMMARY OF THE INVENTION

It is an object of this invention to provide a means to lubricate and cool crankpin and wrist pin rod bearings of a two-cycle internal combustion engine. The rod bearings are lubricated by directing lubricant into a central, longitudinally extending cavity formed in the rod that communicates between the crankpin bearing and the wrist pin bearing through a hole that intersects the internal cavity in the rod. The intersecting hole is exposed to the internal chamber formed by the crankcase of the engine. A mixture of fuel and oil is directed to the interior cavity of the rod from the chamber in the crankcase. The partial vacuum caused by a piston moving in a cylinder away from the crankcase housing draws a supply of fuel and oil from a fuel supply source into the crankcase housing and, from there, the mixture is scooped into the passage formed within the rod through an intersecting hole between the crankcase chamber and the internal cavity or bore in the rod.

A means to lubricate bearing surfaces for a two-cycle internal combustion engine is disclosed which consists of an engine housing that forms bearing surfaces for a crankshaft. The crankshaft forms one or more crankpins, the crankpin forming bearing surfaces thereon. One or more rods form, at a first end, a crankpin bearing surface and, at a second end, a wrist pin bearing surface. A piston retaining wrist pin rotatably connects to the second end of the rod. The piston is reciprocatively contained within a cylinder.

A means to lubricate the rod/crankpin bearing and the rod/wrist pin bearing includes an internal bore formed within the rod. The internal bore communicates between the crankpin bearing and the wrist pin bearing. A passage is formed in the side of the rod and is positioned between the crankpin bearing and the wrist pin bearing. The passage is transverse to the axis of the bore in the rod and intersects the internal bore within the rod. The intersecting passage in the rod communicates with the crankcase chamber formed by the engine housing and the interior bore formed in the rod. As the piston moves up the cylinder, a partial vacuum is created within the crankcase chamber in the housing which, in turn, draws a mixture of fuel and lubricant into the chamber from a fuel supply source. The fuel mixture is in turn directed or scooped into the bore formed in the rod through the bore intersecting passage in the rod as the rod rotates around a flywheel connected to the crankshaft. Fuel and oil is thereby supplied to the interior of the rod which, in turn, lubricates and cools the crankpin bearing and the wrist pin bearing.

The intersecting passage in the side of the rod, positioned between the crankpin bearing and the wrist pin bearing, goes from one side of the rod into the longitudinal bore formed in the rod, the passage being about transverse to the longitudinal bore in the rod. As the rod moves in a circular motion from one side of the engine housing to the other side of the engine housing (as the crankshaft rotates the crankpin within the engine housing), the mixture of fuel and lubricant is scooped into an entrance hole to the intersecting passage in the side of the rod as the crankpin end of the rod, for example, moves clockwise from side to side from about a three o'clock position to about a nine o'clock position during reciprocation of the piston within its cylinder during operation of the two-cycle engine.

An advantage over the prior art is the positioning of a lubricant supply means within the rod to supply the crankpin bearing and the wrist pin bearing with lubricant from within the confines of the rod body to assure cooling of the rod and lubrication of the crankpin and the wrist pin bearings.

Another advantage over the prior art is the means in which lubricant is directed into the hollow interior of the piston rod by utilizing the circular motion of the crankpin end of the rod to scoop in fluid within the engine crankcase to the inside bore or chamber in the rod to assure lubrication of the crankpin and the wrist pin bearings.

An obvious advantage of the present invention is the high pressure developed by a column of fluid in motion within the rod when the piston reaches the limit of its reciprocal travel and reverses itself. Obviously this happens at each end of the rod. It is this high pressure lubricating system that deposits a film of oil between the bearing surfaces with sufficient force to assure lubrication of these bearings, thereby greatly extending the life of the crankpin and wrist pin bearings as well as the rod itself. This type of lubrication system is far superior to lubrication methods used in two-cycle engines whereby bearings are lubricated by a more or less fortuitous encounter with fuel and oil suspended or entrained within the crankcase housing during operation of the engine.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
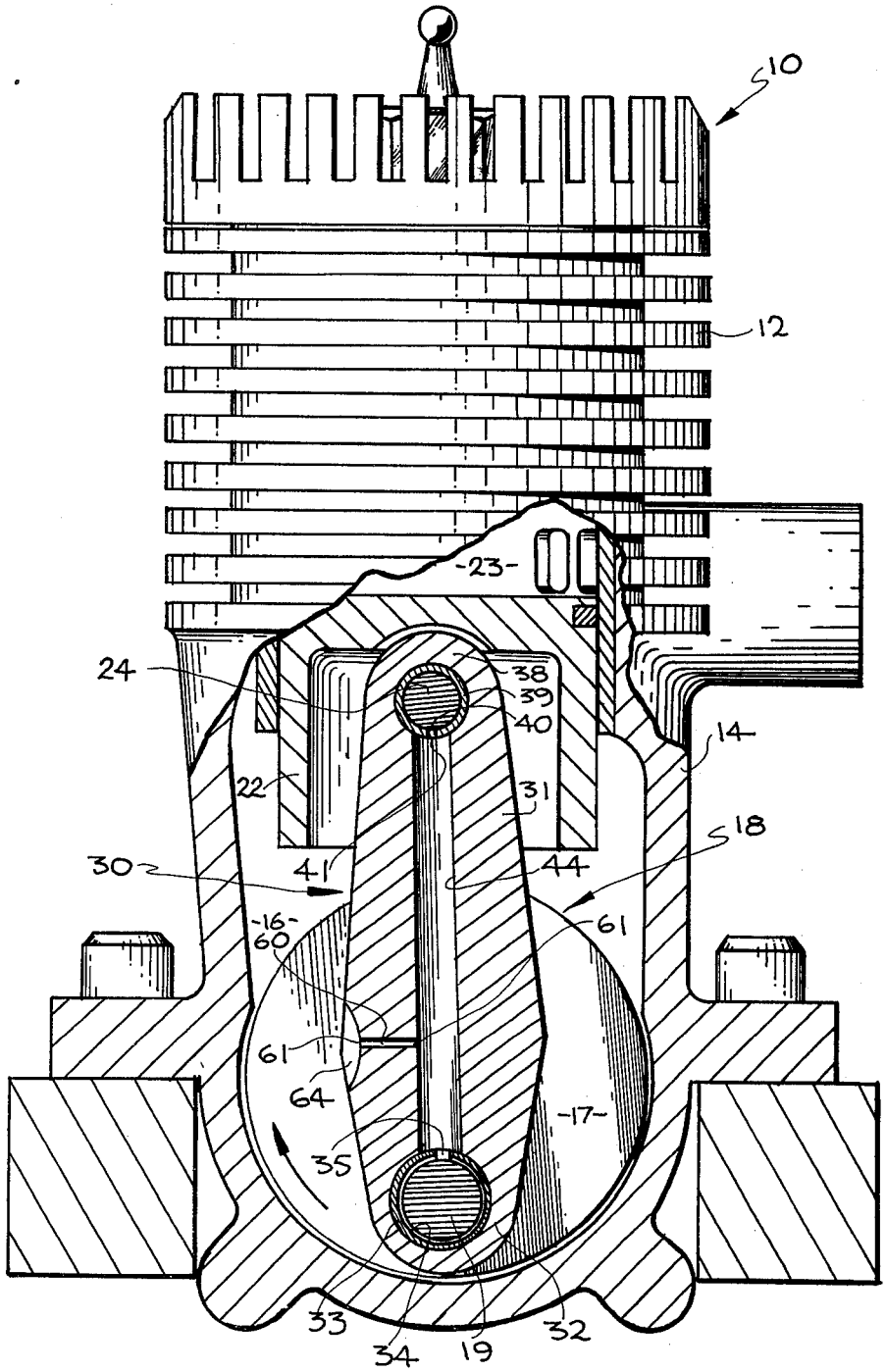
FIG. 1 is a partially cutaway cross section of a typical two-cycle engine, illustrating the rod mechanically linked to the crankshaft and the piston with the means to supply fuel to the bearings at either end of the rod.

With reference now to FIG. 1, the two-cycle engine, generally designated as 10, consists of cylinder head 12, crankcase housing 14, which forms a crankcase chamber 16 thereby. Contained within the crankcase 14 is a crankshaft, generally designated as 18. Contained within the crankcase chamber 16 is flywheel 17, connected to the crankshaft. A crankpin 19 extends from flywheel 17 and connects to a rod, generally designated as 30. A piston 22 is contained within its cylinder 23.

The rod 30 consists of a rod shank 31 and a crankpin end 32. A bronze bushing 33, for example, is pressed into the crankpin end 32 and provides a bearing that mates with crankpin 19 of the crankshaft 18. A circumferential lubrication groove 34 is formed in the bearing wall of the bronze bushing 33. At the opposite end of the rod shank 31 is a wrist pin end 38. Again, a bronze bushing 39 is pressed into the wrist pin end 38. A wrist pin 24 retains piston 22 to end 38 of rod 30. A circumferential lubrication groove 40 (FIG. 5) is provided within the bushing 39 and communicates with a lube access hole 41, centrally positioned within the bushing. The lubrication groove 40 serves to transfer lubricant through lube access hole 41 around the circumferential groove 40 in the bushing to properly lubricate wrist pin 24 retained within the piston 22.

An internal, cylindrical bore 44 is drilled approximately through the center of the rod shank 31 through one end of the rod. The internal, cylindrical bore communicates between the lube access hole 35 in crankpin end 32 and the lube access hole 41 in the wrist pin end 38 of rod 30. The internal bore 44 within the rod shank 31 communicates with the interior chamber 16 formed within crankcase 14 through an access hole or passage 60 that communicates between chamber 16 and the lube hole or bore 44 within shank 31. Since the crankshaft 18, for example, rotates clockwise when viewed from the rear of the engine (as illustrated in FIGS. 1 through 4), the lube access passage 60 is positioned on the left side of the rod between rod ends 32 and 38. The access passage 60 is positioned within a scoop or trough 64 in the side of the rod shank 31. An inlet opening 62 leads into passage 60 and passage 60 terminates at opening 61 which communicates with the bore 44 within the rod shank 31. The access passage 60 is about transverse or ninety degrees to the axis of the bore 44 within the rod.

During engine operation, as the crankshaft rotates within the housing 14, the lower portion of the rod swings from about the three o'clock position to about the nine o'clock position and, during this portion of the swing of the rod, fuel and lubricant drawn into the crankcase 16 is scooped into the access passage 60 through scoop or opening 64 in the side of the rod into the internal bore 44 within the rod. Fuel and lubricant now contained within the rod then is forced down the bore 44, through inertial forces, into the crankpin bearing 33 into groove 34 within the bronze bushing and, from there, into the crankpin bearing surfaces of the crankpin 19 when the rod 30 reverses its reciprocal motion, passing through the six o'clock position. As the piston reaches top dead center and starts down its power stroke, a column of lubricant is driven up the bore 44 into the wrist pin 24, under high pressure, through lube access hole 41 in bushing 39, thus providing lubricant to the wrist pin during this portion of the stroke of the piston. The bore within the rod eventually fills completely with fuel and oil, the cavity or bore 44 being continually refilled as the engine continues operation.

Figure 2:
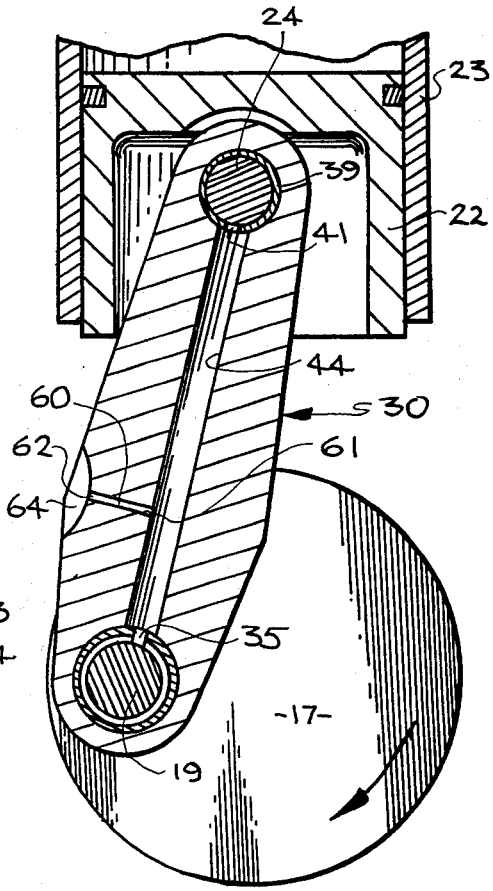
FIG. 2 is a partially cutaway cross section of the engine with the crankshaft/crankpin being positioned ninety degrees from the position shown in FIG. 1.

To illustrate the foregoing cycle, reference is made to FIG. 2. The rod is shown in the nine o'clock position, the fuel being driven or scooped into the access passage 60 through opening 64 into the bore 44.

Figure 3:
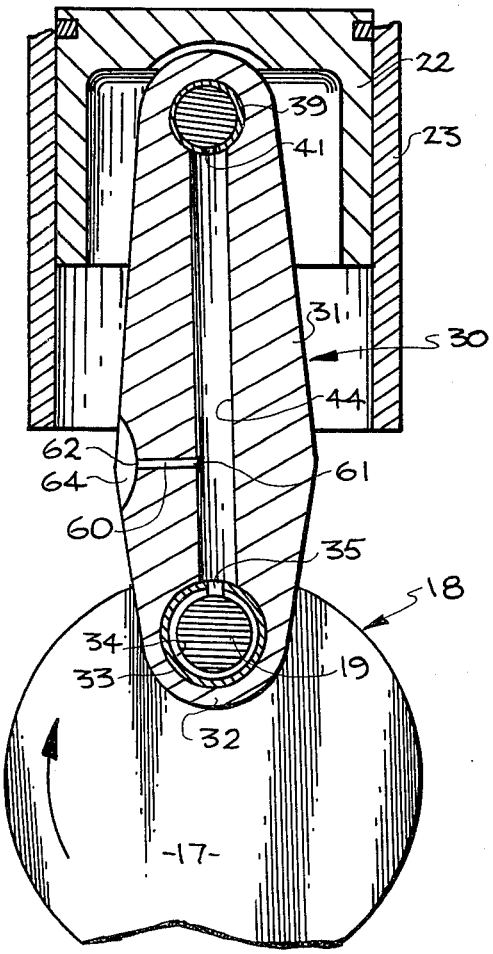
FIG. 3 is a partially broken-away cross section of the engine with the crankshaft/crankpin positioned ninety degrees from the position shown in FIG. 2.

FIG. 3 shows the piston at top dead center (TDC). Lubricant within the bore 44 is driven, through inertial forces under relatively high pressure, into the crankpin bearing surfaces as the piston travels through the bottom of its stroke to TDC. Lubricant enters through lube access hole 35 in bushing 33 and circulates around the circumferential groove 34 in the bushing 33 to provide pressurized lubricant to the bearing surfaces on the crankpin 19.

Figure 4:
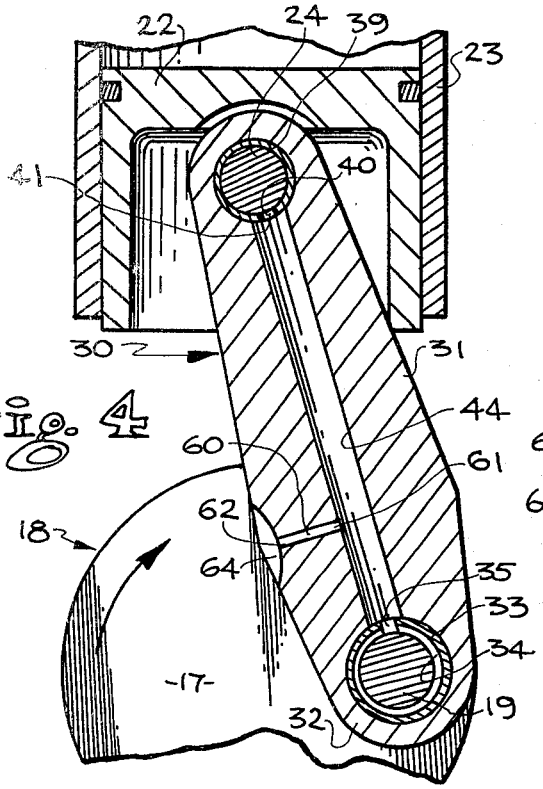
FIG. 4 is a partially broken-away cross section of the engine with the crankshaft/crankpin being positioned ninety degrees from the position shown in FIG. 3.

FIG. 4 shows the crankshaft rotated ninety degrees from the position shown in FIG. 3. The piston is about to start on its power stroke. The column of lubricant then is driven, through inertial forces under high pressure, toward the wrist pin 24 through lube access hole 41 into groove 40 within bushing 39, thus providing pressurized lubricant to the wrist pin during operation of the engine.

It can readily be realized then that the bearing surfaces at opposite ends of the rod 30 are lubricated through a column of lubricant contained within the rod to assure proper lubrication to these critical bearing surfaces during operation of the engine without the aid of complicated pumps or valves to force lubricant into these bearing surfaces. The action of the crankpin end 32 of rod 30, moving in a clockwise circular motion from about a three o'clock position to about a nine o'clock position, picks up fuel and lubricant entrained within the crankcase 16 of the engine through scoop 64 into passage 60 and, from there, into the bore 44 within the rod. Thus, during at least half to three-quarters of the rotation of the flywheel 17 of the crankshaft 18, fuel entrained in the crankcase is picked up through scoop 64 to continually provide a column of fuel and lubricant to the internal bore of the rod.

Figure 5:
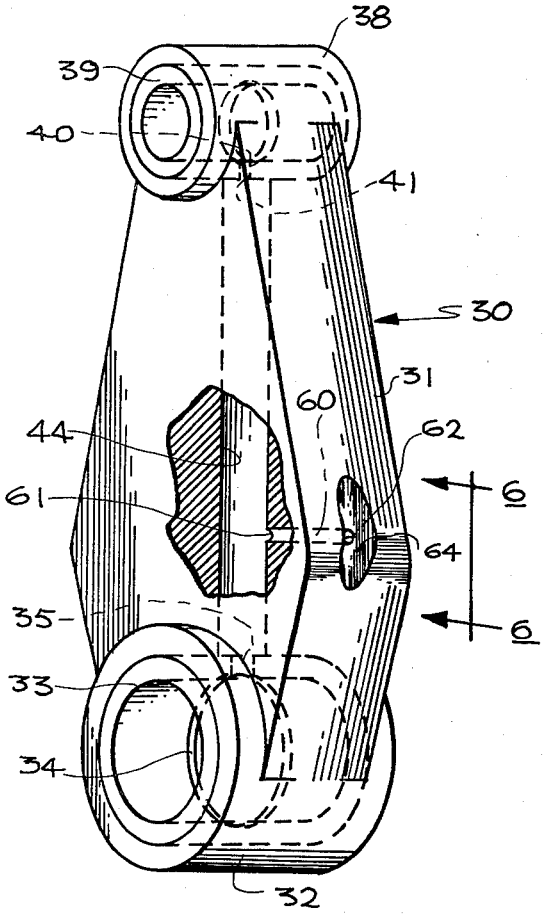
FIG. 5 is an enlarged perspective view of the rod illustrating the longitudinally extending internal cavity communicating between the crankpin bearing and the wrist pin bearing and the intersecting hole transverse to the internal passage in the rod that communicates between the outside of the rod to the interior cavity within the rod.

Turning now to the perspective view illustrated in FIG. 5, the rod 30 clearly illustrates the bearing surfaces at opposite ends of the rod. At the bottom end 32 of the rod is housed a bushing 33 which has a circumferential groove or slot 34 formed in the bearing surfaces of the bushing 33, the slot 34 being intersected by a lube access hole 35 that communicates between groove 34 and the internal cavity or bore 44 within the rod. At the opposite end 38 of the rod shank 31 is a similar bronze bushing 39. The bushing 39 has a circumferential slot 40 which intersects and communicates with a lube access hole 41 which in turn communicates with the bore 44 within the rod shank 31. The bore 44 communicates with the crankcase 16 through lube access passage 60 in the side of the rod shank. Lubricant and fuel enter through scoop or pickup slot 64 in the rod shank through inlet hole 62. Fuel and lubricant fills bore 44 through opening 61 of the lube access passage 60.

Figure 6:
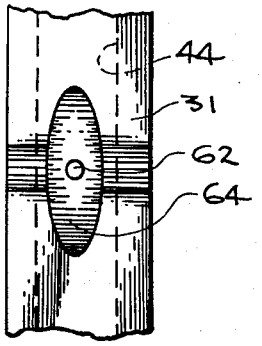
FIG. 6 is a view taken from 6—6 of FIG. 5 illustrating the scoop inlet for the mixture of fuel and oil entrained within the engine crankcase.

FIG. 6 clearly defines the scoop 64 in the rod shank 31, illustrating the entrance opening 62 to fuel access port 60 (FIG. 5).

The combination of the circular motion of the bottom end of the rod 32 and, more importantly, the inertial forces acting upon the rod shank 31 of rod 30 serves to scoop in and force lubricant and fuel under high pressure to opposite ends of the rod 32 and 38 to both lubricate and cool the crankpin and the wrist pin of the two-cycle internal combustion engine. The circular motion of the rods, combined with the internal pressures within the crankcase of the engine, serves to drive a mixture of fuel and lubricant into the access port 60 to the passage 44 within the rod. The inertial forces exerted on the rod by the piston reciprocating within its cylinder forces the column of lubricant within the rod either into the crankpin or the wrist pin bearing surfaces during operation of the engine. High pressures are generated on the column of liquid when the rod reverses its reciprocal direction.

This invention therefore uniquely and simply addresses the critical problem of overheating crankpin bearings and wrist pin bearings during high RPM's typical of two-cycle engines. By feeding lubricant under pressure to these critical bearing surfaces from within the confines of the rod, lubrication is assured to these bearing surfaces, thus preventing catastrophic failure of the rod or the rod bearings during high-speed operation of these types of engines.

This is a particular problem, as heretofore stated, with miniature two-cycle engines which tend to turn at very high RPM's.

It would be obvious to position the passage 60 on the right side of the rod shank 31 if the engine should rotate counterclockwise when viewed from the rear. Fuel would then be picked up through inlet scoop 64 from about the nine o'clock position to about the three o'clock position.

It would additionally be obvious to admit fuel and oil to the internal cavity in the rod through more than one hundred and eighty degrees of rotation of the rod bottom 32 as the crankpin 19 swings the rod from side to side.

The partial vacuum within the crankcase 16, created when the piston moves up the cylinder, will additionally encourage admittance of fuel to cavity 44.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

I claim:

1. A method to lubricate and cool a piston rod and rod bearings, said rod being connected between a crankpin of a crankshaft and a wrist pin secured to a piston for a two-cycle internal combustion engine comprising the steps of:

forming a longitudinally extending bore within said rod, said bore communicates between said crankpin at a first end of said rod and said wrist pin at a second end of said rod, forming an interconnecting passage means in said rod that communicates between said longitudinally extending bore and a crankcase chamber formed by and within an engine block of said two-cycle engine, forming an inlet trough in said rod at an entrance to said passage means communicating between said crankcase chamber and said longitudinal bore formed in said rod, said passage means being about transverse to the axis of the bore in the rod, said passage means further being located on the left-hand side of the rod when said rod rotates in a clockwise direction, injecting a combustible mixture of fuel and oil within said crankcase chamber from a source of said fuel and oil communicating with said chamber, and collecting said mixture of fuel and oil entrained within said chamber through said interconnecting passage in said rod communicating between said longitudinally extending bore in said rod and said chamber, said fuel and oil enters said bore in said rod and exits through a crankpin rod bearing and a wrist pin rod bearing as said rod reciprocates with said piston and rotates around said crankshaft through said crankpin from about a three o'clock position to about a nine o'clock position as said crankshaft rotates clockwise thereby admitting fuel and oil into said bore within said rod to lubricate said crankpin and wrist pin bearings and to cool said rod during engine operation.

2. The method as set forth in claim 1 further comprising the step of driving a column of said mixture of fuel and oil contained within said longitudinal bore formed in said rod alternately into said crankpin bearing or said wrist pin bearing through an inertia force generated by the reciprocal action of the rod as the piston reciprocates within its cylinder, said column of fuel and oil enters said crankpin bearing or said wrist pin bearing under high pressure as said rod reverses its reciprocal motion during engine operation.

3. A method of forming a lubrication passage within a rod to lubricate crankpin and wrist pin bearings for a two-cycle internal combustion engine comprising the steps of:

drilling a longitudinally extending bore in said rod through an end of said rod, said bore communicates with said crankpin bearing and said wrist pin bearing, and drilling an intersecting passage in said rod through a side of said rod, said passage being in communication between a crankcase chamber formed in an engine block of said engine and said bore in said rod, an axis of said intersecting passage being oriented about ninety degrees from an axis of said bore in said rod.

4. The method as set forth in claim 3 wherein said intersecting passage formed in said rod is located on the left-hand side of said rod when a crankshaft of said engine drives said crankpin in a clockwise direction.

5. A means to lubricate rod bearing surfaces for a two-cycle internal combustion engine comprising:

an engine housing forming a crankcase chamber and bearing surfaces for a crankshaft, said crankshaft forming one or more crankpins, said crankpin forming bearing surfaces thereon, one or more rods forming, at a first end, a crankpin bearing surface, said crankpin bearing surface mates to said crankshaft crankpin and, at a second end of said rod, a wrist pin bearing surface, said wrist pin bearing surface mates to a wrist pin in a piston, said piston being contained within a cylinder, and lubrication means contained within a longitudinally extending bore formed in said one or more rods, said bore communicates with said crankpin bearing surface at said first rod end and said wrist pin bearing surface at said second rod end, an opening formed in said rod leads to a passage means formed in said rod, said passage means communicates between said crankcase chamber and said longitudinally extending bore formed within said one or more rods, as said one or more rods reciprocates within said crankcase chamber formed by said engine housing, a mixture of fuel and oil entrained within said crankcase chamber from a source of fuel and oil communicating with said chamber is picked up through said opening to said passage means in said rod to admit fuel and oil contained within said crankcase chamber into said bore of said one or more rods to lubricate said crankpin and wrist pin bearings and to cool said rod as said one or more rods reciprocates and rotates around said crankpin during operation of said two-cycle engine.

6. The invention as set forth in claim 5 wherein said opening to said passage means is an enlarged trough formed in the side of said one or more rods, said trough serves to scoop said entrained fuel and oil within said crankcase chamber into said bore formed in said one or more rods during engine operation.

7. The invention as set forth in claim 5 wherein said two-cycle internal combustion engine is a miniature two-cycle engine.

8. The invention as set forth in claim 7 wherein said miniature two-cycle engine operates in a revolution per minute range of from two thousand RPM's to thirty thousand RPM's.

9. A method of lubricating rod bearings for two-cycle engines comprising the steps of:

forming a longitudinally extending bore in a rod, said bore communicates with said rod bearings, forming an interconnecting passage in said rod between said bore in said rod and a crankcase chamber of said engine, said passage communicating therebetween, passing a source of lubricant entrained within said chamber into said bore in said rod through said interconnecting passage during operation of said engine, said lubricant forming a column of lubricating liquid within the bore formed in said rod, said column of liquid is alternately forced into one of said rod bearings under high pressure through inertia forces exerted on said column of liquid when said rod reaches its reciprocal limit and reverses direction, the opposite bearing being lubricated similarly by said column of liquid as said rod again reaches its reciprocal limit and reverses direction.

* * * * *